US009926742B2

(12) United States Patent
Leng

(10) Patent No.: US 9,926,742 B2
(45) Date of Patent: Mar. 27, 2018

(54) TOP STEP FOR ALUMINUM LADDER

(75) Inventor: Luhao Leng, Xiamen (CN)

(73) Assignee: New-Tec Integration (Xiamen) Co., Ltd., Xiamen, Fujian (CN)

( * ) Notice: Subject to any disclaimer, the term of this patent is extended or adjusted under 35 U.S.C. 154(b) by 588 days.

(21) Appl. No.: 13/059,301

(22) PCT Filed: Sep. 2, 2009

(86) PCT No.: PCT/CN2009/073689

§ 371 (c)(1),
(2), (4) Date: Feb. 16, 2011

(87) PCT Pub. No.: WO2010/037296

PCT Pub. Date: Apr. 8, 2010

(65) Prior Publication Data

US 2011/0147123 A1 Jun. 23, 2011

(30) Foreign Application Priority Data

Sep. 27, 2008 (CN) ..... 2008 1 0071881

(51) Int. Cl.
*E06C 1/393* (2006.01)
*E06C 7/08* (2006.01)
*E06C 1/39* (2006.01)

(52) U.S. Cl.
CPC ..... *E06C 1/393* (2013.01); *E06C 1/39* (2013.01); *E06C 7/08* (2013.01)

(58) Field of Classification Search
CPC . E06C 7/08; E06C 7/081; E06C 1/393; E04G 5/08
USPC ..... 182/180.1, 165, 161, 228.2, 194, 222; 403/339, 340, 393
See application file for complete search history.

(56) References Cited

U.S. PATENT DOCUMENTS

| | | | | | |
|---|---|---|---|---|---|
| 1,555,483 | A | * | 9/1925 | Rosenberg | 182/176 |
| 2,265,735 | A | * | 12/1941 | Lambert | 182/228.2 |
| 2,448,264 | A | * | 8/1948 | Jung | 182/194 |
| 2,574,286 | A | * | 11/1951 | Rein | 182/165 |
| 3,005,513 | A | * | 10/1961 | Larson | 182/165 |
| 4,204,587 | A | * | 5/1980 | Larson | 182/228.1 |
| 4,332,308 | A | * | 6/1982 | Larson | 182/120 |
| 4,505,082 | A | * | 3/1985 | Schmitz | 52/309.8 |
| 4,848,517 | A | * | 7/1989 | Broyles, III | 182/83 |
| 4,984,673 | A | * | 1/1991 | Saito et al. | 198/333 |

(Continued)

FOREIGN PATENT DOCUMENTS

| | | |
|---|---|---|
| CN | 2237710 Y | 10/1996 |
| CN | 2644393 Y | 9/2004 |

(Continued)

*Primary Examiner* — Colleen M Chavchavadze
(74) *Attorney, Agent, or Firm* — Edward E. Sowers; Brannon Sowers & Cracraft PC

(57) ABSTRACT

A top step for a step ladder is described. The top step comprises an assembled member comprising two or more step elements, two side members and a metal tube. The front end and the rear end of the assembled aluminum member are provided with front and rear skirts, respectively. The upper and the lower end of the side members have an upper edge and a lower edge for clamping to the two sides of the assembled member or the two sides of an assembled unit formed by the metal tube and the assembled aluminum member, thereby covering the spaces between the front skirt and the back skirt.

12 Claims, 11 Drawing Sheets

(56) References Cited

U.S. PATENT DOCUMENTS

| | | | | |
|---|---|---|---|---|
| 4,990,049 | A * | 2/1991 | Hargrove | 414/537 |
| 5,711,400 | A * | 1/1998 | Tan | 182/119 |
| 6,467,234 | B1 * | 10/2002 | Marshall | 52/741.2 |
| 6,786,300 | B1 * | 9/2004 | Bonifacini | 182/120 |
| 2005/0029050 | A1 * | 2/2005 | Baumgartner et al. | 182/165 |
| 2010/0170750 | A1 * | 7/2010 | Leng | 182/219 |
| 2011/0209946 | A1 * | 9/2011 | Leng | 182/129 |

FOREIGN PATENT DOCUMENTS

| | | | | |
|---|---|---|---|---|
| CN | 2729200 | Y | 9/2005 | |
| CN | 201108205 | Y | 9/2008 | |
| EP | 1036892 | A2 | 9/2000 | |
| FR | 2870868 | A1 * | 12/2005 | E06C 7/081 |
| GB | 2156889 | A | 10/1985 | |

* cited by examiner

TOP STEP FOR ALUMINUM LADDER

FIELD OF THE INVENTION

The present invention relates to a ladder, in particular, the present invention relates to a top step for a simple aluminum step ladder.

BACKGROUND OF THE INVENTION

Prior art aluminum step ladders are generally made of aluminum and comprise two front aluminum leg tubes, two back aluminium leg tubes, one or more bottom aluminum step and a top step made of a material. The two front leg tubes and the two corresponding back leg tubes joint pivotally, so that the front leg tubes and the back leg tubes can open up to form a herringbone supporting structure. The one or more bottom step is connected between the two front leg tubes. The number of the bottom steps depends on the height of the ladder. The higher the ladder is, the more bottom steps the ladder has. For a step ladder, it generally has one or two bottom steps, but may have more. The top step is connected between the two front leg tubes and the two back leg tubes. The front portion of the top step joints pivotally with the two front leg tubes, and the rear portion of the top step joints pivotally with the back leg tubes through a connecting member. When the front leg tubes and the back leg tubes are in an open position, the top step positions the front leg tubes and the back leg tubes, so the ladder opens up. When the front leg tubes and the back leg tubes are in a folded position, the top step is stored in the space between the front leg tubes and the back leg tubes. The top step provides a standing surface for the user, so the top step is generally bigger than the bottom step. If the top step is entirely made of full aluminum material, the manufacturing may be difficult, and may need more materials, thereby increasing the cost and reducing the competitive advantages of the products.

SUMMARY OF THE INVENTION

The object of the present invention is to overcome the disadvantages of the existing technology. The present invention provides a top step for a step ladder, manufactured using aluminum and plastic components. The top step is advantageously easy to manufacture, and has an appealing appearance, a stable supporting, and a low production cost, resulting in a competitive product.

The technology of the present invention intends to resolve the problem of the prior art technology.

In accordance with one embodiment of the present invention, there is provided a step ladder comprising: two rear leg tubes; two front leg tubes joining the two rear leg tubes pivotally at respective ends of the rear leg tubes; at least one bottom step located between the two front leg tubes; a top step having a front portion and a rear portion, the front portion pivotally connected to the two front leg tubes, the rear portion joining the two rear leg tubes through two connecting members, the top step comprising: an assembled member comprising a front step element and a rear step element, the front step element having a front skirt extending downwards at a front end, and a rear edge with a U-shaped end, the rear step element having a rear skirt downwards at a rear end and a front edge with a U-shaped end; a metal tube located at two sides of the assembled member and between the front skirt and the rear skirt; two side members covering the metal tube at the two sides of the assembled member and the space between the front skirt and the rear skirt, each of the side members having an upper covering edge and a lower covering edge; wherein the upper covering edge and the lower covering edge of each of the side members clamp to a respective side of the assembled member; and wherein each of the U-shaped end of the front step element and the U-shaped end of the rear step element engages a corresponding U-shaped end for connection thereto.

Preferably, the U-shaped end of the front step element and the U-shaped end of the rear step element have a sideways hook shape, with an opening inwards.

Preferably, the assembled member further comprises a middle step element, wherein the middle step element has a rear edge with a U-shaped end, and a front edge with a U-shaped end, wherein the rear edge of the front step element connects to the front edge of the middle step element and wherein the front edge of the rear step element connects to the rear edge of the middle step element.

Preferably, the two front leg tubes and the two rear leg tubes are made of aluminum.

Preferably, the front step element and the rear step element are made of aluminum.

Preferably, the front step element and the rear step element are single-layered.

Preferably, the metal tube is made of iron.

Preferably, the metal tube is made of aluminum.

Preferably, the metal tube has an H-shape.

Preferably, the metal tube has a U-shape.

Preferably, the metal tube is a closed frame.

Preferably, a surface of the front step element and a surface of the rear step element have raised lines.

Preferably, a surface of the front step element and a surface of the rear step element have impressions arranged in rows.

Advantageously, the top step in accordance with the present invention comprises an assembled aluminum member, side plastic members and a metal tube. The assembled aluminum member comprises two or more step elements. The width of the step elements is relatively narrow, so that a light aluminum extrusion presser can be used to produce them. The assembled aluminum member may be provided with a metal tube, to enhance the strength of the top step, resulting in a more stable support. At the same time, the metal tube also connects the individual step elements. The side plastic members cover the two sides of the assembled aluminum member or the two sides of an assembly unit formed by the assembled aluminum member and the metal tube and the two side spaces between the front and the back side skirt, providing an appealing appearance to the top step, and reduces the aluminum material used and the production cost. The impression on the surface of the step elements makes the top step more attractive. The upper surface of the step element may have raised lines, providing profiles to the upper surface and reference for assembling the assembled aluminum member, and an antiskid function during use. The edges of the two neighboring step elements have two sideways U-shaped ends, a vertical hook structure, a U-shaped end structure or a horizontal hook with a U-shaped end, and a vertical hook with a U-shaped end structure for connecting the two step elements, resulting in a stable connection and easy to manufacture.

Below is a detailed description of non-limiting embodiments in accordance with the present invention.

DETAILED DESCRIPTION OF THE INVENTION

Embodiment 1

Figure 1:
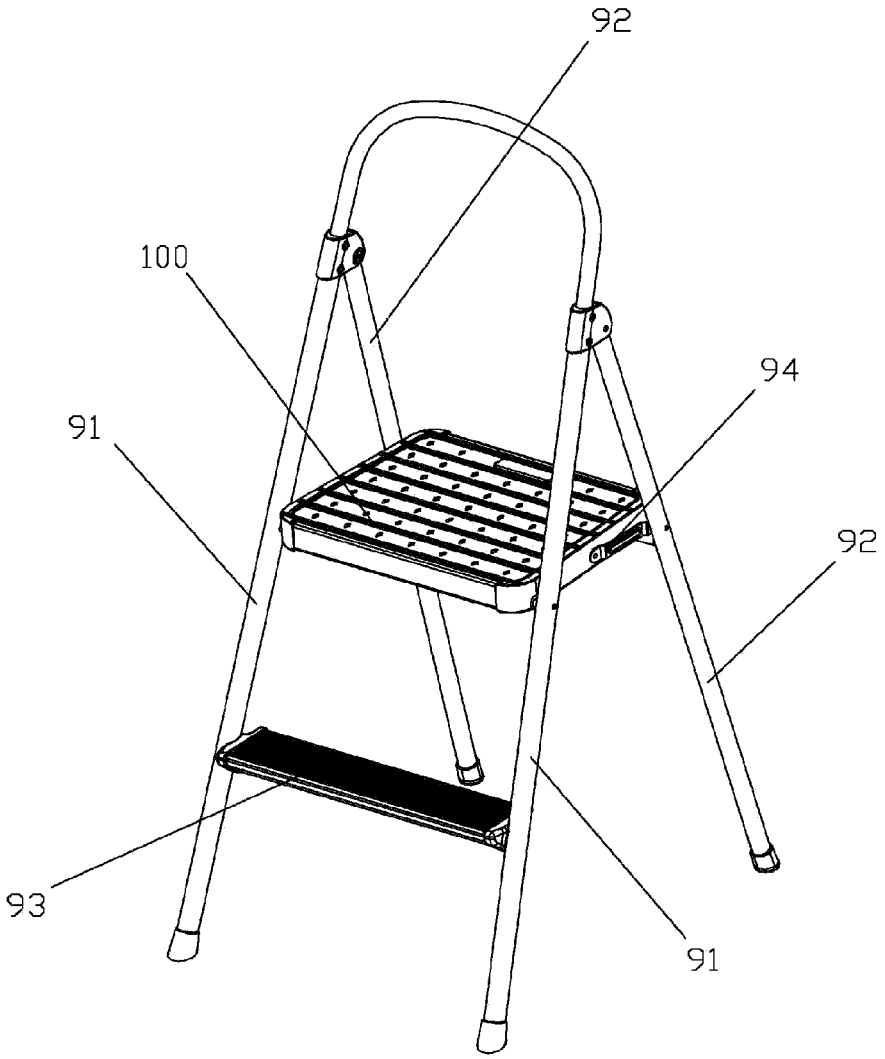
FIG. 1 is a perspective view of a ladder comprising a top step in accordance with the present invention.
Figure 2:
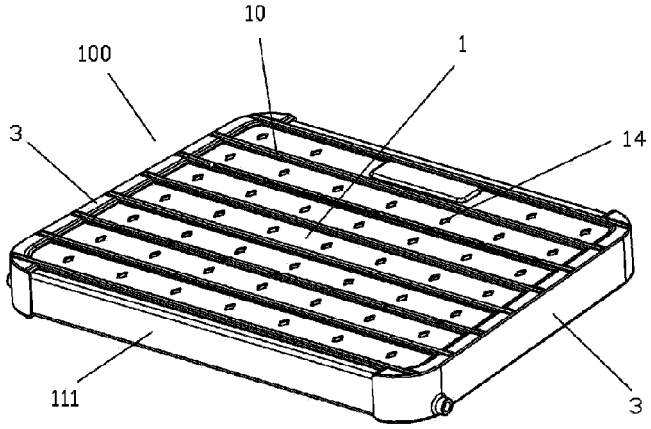
FIG. 2 is a perspective view of the top step of embodiment 1.
Figure 3:
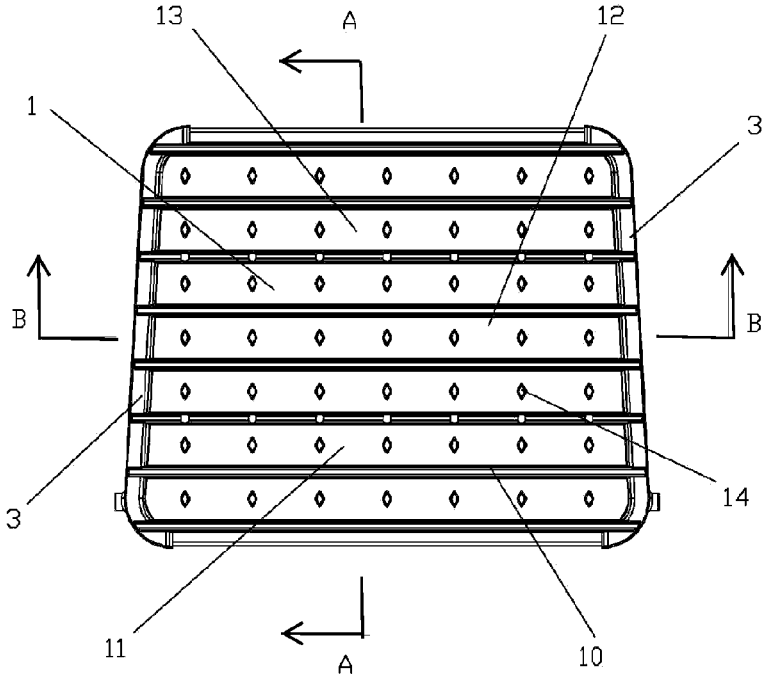
FIG. 3 is a top view of embodiment 1.
Figure 4:
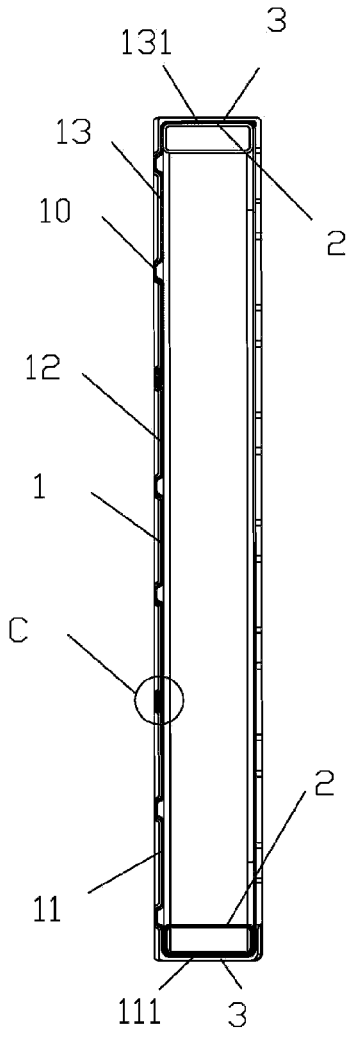
FIG. 4 is a sectional view along the A-A line in FIG. 3.
Figure 5:
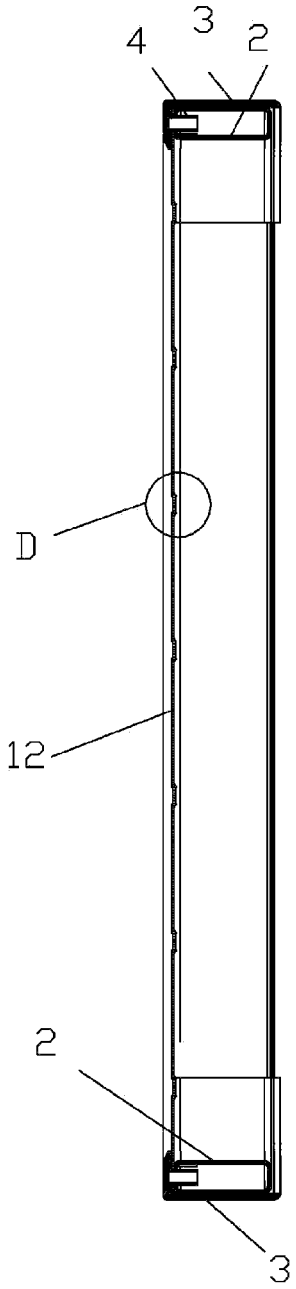
FIG. 5 is a sectional view along the B-B line in FIG. 3.

Referring to FIG. 1, the present invention provides a top step for an aluminum step ladder. The ladder includes two aluminum front leg tubes 91, two aluminum rear leg tubes 92, an aluminum bottom step 93, and a top step 100. The two front leg tubes 91 may be made from a straight tube and bent to a U-shape, the top of the U-shaped front leg tubes can function as a handrail. Two front leg tubes 91 and the corresponding rear leg tubes 92 joint pivotally at the end of the rear leg tubes 92, so that the front leg tubes 91 and the rear leg tube 92 can open up to form a herringbone supporting structure. The bottom step 93 is connected between the two front leg tubes 91. It should be apparent to a person skilled in the art that there could be more than one bottom step. The top step 100 is connected between the two front leg tubes 91 and the two rear leg tubes 92, the front portion of the top step 100 joint pivotally to the two front leg tubes 91. The rear portion of the top step 100 joints separately to the two rear leg tubes 92 by the respective connecting members 94. When the front leg tubes 91 and the rear leg tubes 92 are in an open position, the top step 100 is supported between the front and the rear leg tubes. When the front leg tubes 91 and the rear leg tubes 92 are in folded position, the top step 100 is stored in the space between the front and the rear leg tubes. The ladder may also function as a seat whereby the top step 100 is used as a seat.

Referring to FIGS. 2 to 11, the top step 100 comprises:

An assembled aluminum member 1 assembled by three aluminum step elements: a front aluminum step element 11, a middle aluminum step element 12, and a rear aluminum step element 13 which are assembled one by one. The front end and the rear end of the assembled aluminum member 1 are provided with skirts extending downwards. The front skirt 111 is set in front of the front aluminum step element 11, the rear skirt 131 is provided at the back of the rear aluminum step element 13.

A metal tube 2, is made from a straight tube and bent to U-shape by a tube bending machine, is present in this embodiment. The metal tube 2 is placed underneath the front end and the two side ends of the assembled aluminum member 1. The metal tube 2 is also placed behind the front skirt 111 in the assembled aluminum member. The metal tube 2 is fixed to the two sides of the assembled aluminum member.

Two side plastic members 3, which can clamp to the two sides of the assembly of the metal tube 2 and the assembled aluminum member 1. The two side plastic members 3 also cover the two spaces side interspaces between the front skirt 111 and the rear skirt 131 of the assembled aluminum member.

The metal tube 2 is a tube made of iron material or aluminum material.

The top end of the step elements, that is, the front step element 11, the middle step element 12 and the rear step element 13, may be provided with raised lines 10, made by extrusion.

The upper surface of the step elements, for example, the front step element 11, the middle step element 12, and the rear step element 13, may be provided with impressions 14 in rows by extrusion forming. The impressions 14 have a rhombus shape.

The upper and the lower end of the plastic members 3 are provided with an upper covering edge 31 and a lower covering edge 32. The upper covering edge 31 is equipped with notch 311 for accommodating the raised lines 10 of the step elements.

The ends of the assembled aluminum member 1 and the metal tube 2 may be fixed by core pulling rivet. The bottom of the upper covering edge 31 of the side plastic member 3 may have concave grooves 312 for accommodating the rivet 4.

The step elements, that is, the front step element 11, the middle step element 12, and the rear step element 13, have a single-layer structure.

Figure 6:
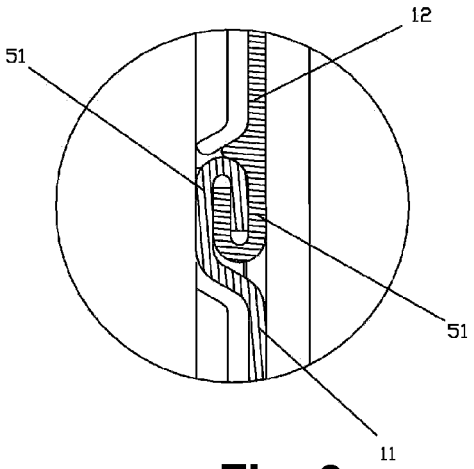
FIG. 6 is an enlarged view of the C section in FIG. 4.
Figure 7:
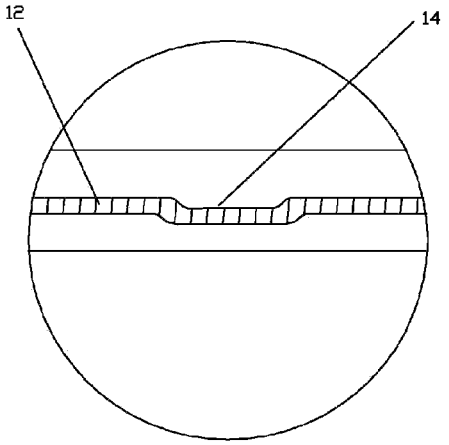
FIG. 7 is an enlarged view of the D section in FIG. 5.
Figure 8:
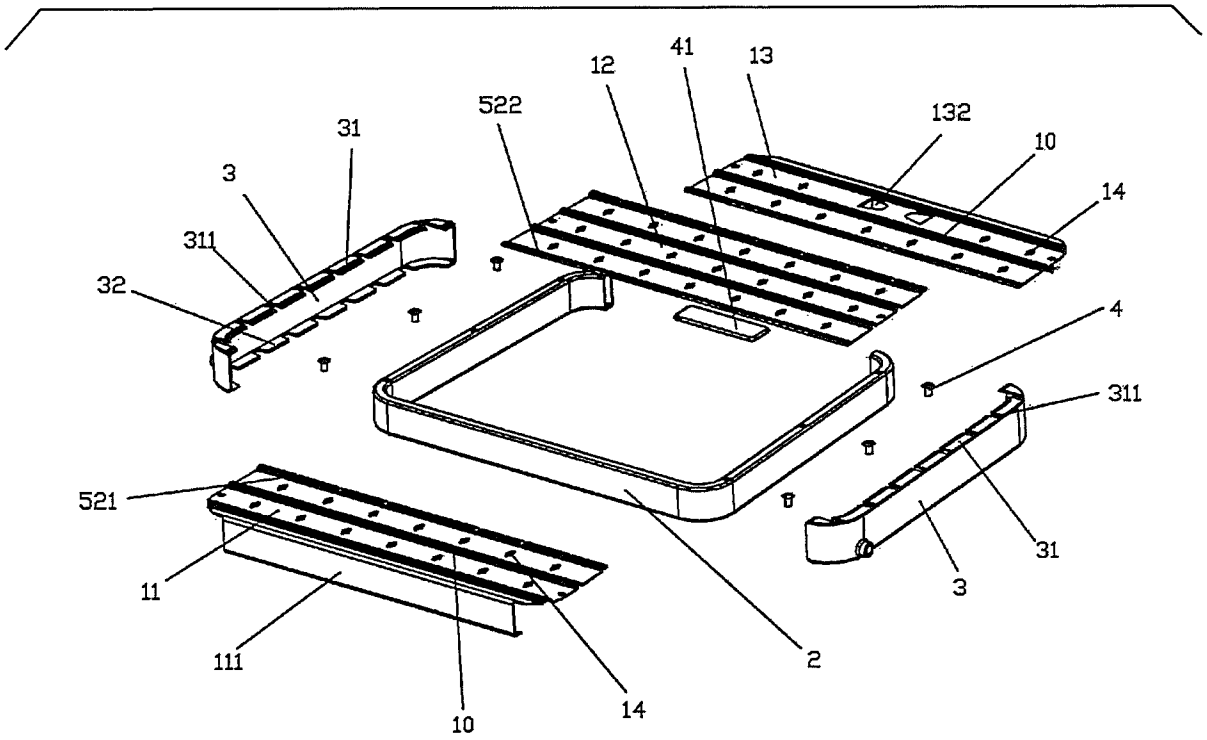
FIG. 8 is an exploded view of embodiment 1.
Figure 9:
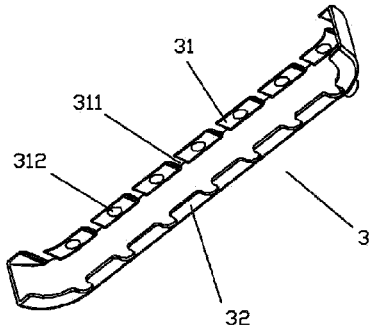
FIG. 9 illustrates the structure of the side plastic member.
Figure 10:
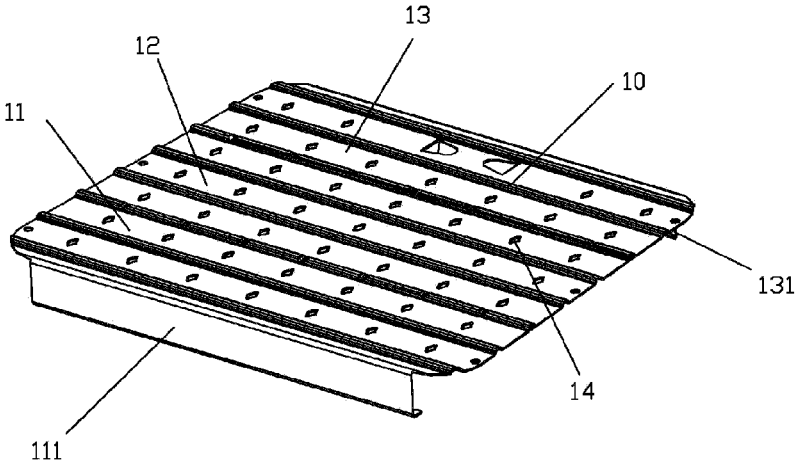
FIG. 10 is a perspective view of the assembled aluminum member of embodiment 1.
Figure 11:
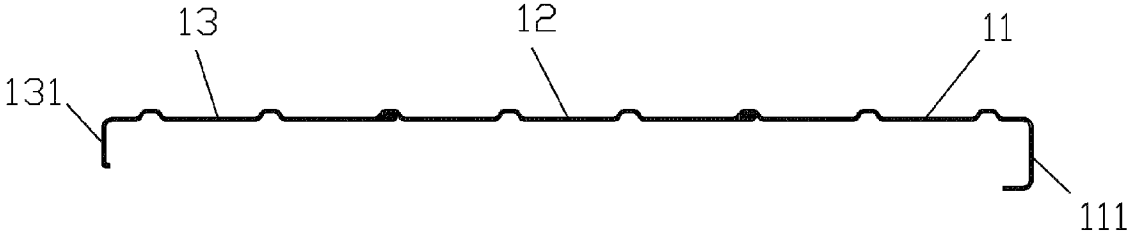
FIG. 11 is a sectional view of the assembled aluminum member of embodiment 1.

Referring to FIG. 6, the edges linking the neighboring step elements are provided with a sideway U-shaped end with an inward opening, the rear edge of the front step element 11 connect with the front edge of the middle step element 12. Therefore, the edges of the front step element 11 and the middle step element 12 have sideway U-shaped ends 51, that is, the sideway U-shaped end 51 in the back side edge of the front step element 11, and the sideway U-shaped end 511 in the front side edge of the middle step element 12. The sideway U-shaped end 51 in the rear side of the front step element 11 hooks with the sideway U-shaped end 51 in the front side of the middle step element 12, holding the front step element 11 and the middle step element 12 together. Similarly, the rear edge of the middle step element 12 receives the front edge of the rear step element 13, the rear edge of the middle step element 12 and the front edge of the rear step element 13 have sideway U-shaped ends to hook together for holding the middle step element 12 and the rear step element 13. The front step element 11, the middle step element 12, and the rear step element 13 are hooked together to form the assembled aluminum member 1.

The edges of the two neighboring step elements may have cooperating bayonet mounts. The rear edge of the front step element 11 is equipped with bayonet mount 521, and the front edge of the middle step element 12 is equipped with bayonet mount 522. As the rear edge of the front step element 11 engages the front edge of the middle step element 12, the bayonet mount 521 of the front step element 11 engages the bayonet mount 522 of the middle step element 12. There are bayonet mounts in the rear edge of the middle step element 12 and the front edge of the back step element 13 as well. A plastic covering 41 is provided to cover the holes 132 of the rear step element 13.

The top step for the aluminum step ladder of the present invention is assembled using the assembled aluminum member 1, side plastic member 3 and the metal tube 2. The assembled aluminum member 1 is formed by the assembly of the front step element 11, the middle step element 12 and the rear step element 13. The reduced width of the individual step elements makes the extrusion on a light aluminum extrusion presser possible. The corner of every step element, corresponding to the corner of the assembled aluminum member, may be made by cold pressing. The metal tube 2 is made from iron tube or aluminum tube. The metal tube could be U-shaped made from a straight tube and bent by a tube bender, H-shaped closed frame shaped, or made from two single tubes. These metal tube shapes have the feature of at least two tubes placed separately on the two sides of the assembled aluminum member 1. When the metal tube 2 is U-shaped, the three sides of the U correspond to the front and the two sides of the assembled aluminum member 1. The two side tubes of the metal tube 2 are fixed with the two side ends of the assembled aluminum member 1, forming the assembly unit of the metal tube 2 and the assembled aluminum member 1. The assembled aluminum member 1 and the metal tube 2 are fixed together by rivet 4, or other cold pressing. The side plastic member 3 is formed by molding, and functionally covers the edges. The side plastic member 3 has an upper covering edge 31 and a lower covering edge 32, so that the side plastic member 3 is formed with notches. The notches can clamp to the two sides of the assembly unit formed by the metal tube 2 and the assembled aluminium member 1 and the two side spaces between the front skirt 111 and the rear skirt 131 at the same time. This arrangement makes the top step 100 more appealing in appearance, and reduces the use of the aluminum material, and the cost of the product. The surface of the step elements has rows of impressions 14. The impressions may be geometric figures such as rhombic, triangle, circle, or even other patterns such as flowers. The impressions beautify the top step and also function as antiskid. The impressions may be arranged linearly, in a curve or another fashion. The upper surface of the step element may also have raised lines made by extrusion forming. These raised lines also contribute to the appearance and provide antiskid function, and facilitate the clamping of the side plastic member 3.

During the manufacturing process, the three step elements, that is, the first step element 11, the middle step element 12 and the rear step element 13; the raised lines 10, the printing 14, the edges and the skirts are first produced. A metal tube is bent into the U-shaped metal tube 2. The three step elements are assembled to form the assembled aluminum member 1. The assembled aluminum member 1 and the metal tube 2 are assembled. The two ends of the assembled aluminum member 1 are fastened to the corresponding two side tubes of the metal tube 2 to form the assembly unit. Lastly, the side plastic members 3 are clamped to the assembled aluminum member 1 and the metal tube 2, covering the two side spaces between the front skirt 111 and the rear skirt 131 to form the top step 100.

Embodiment 2

Figure 12:
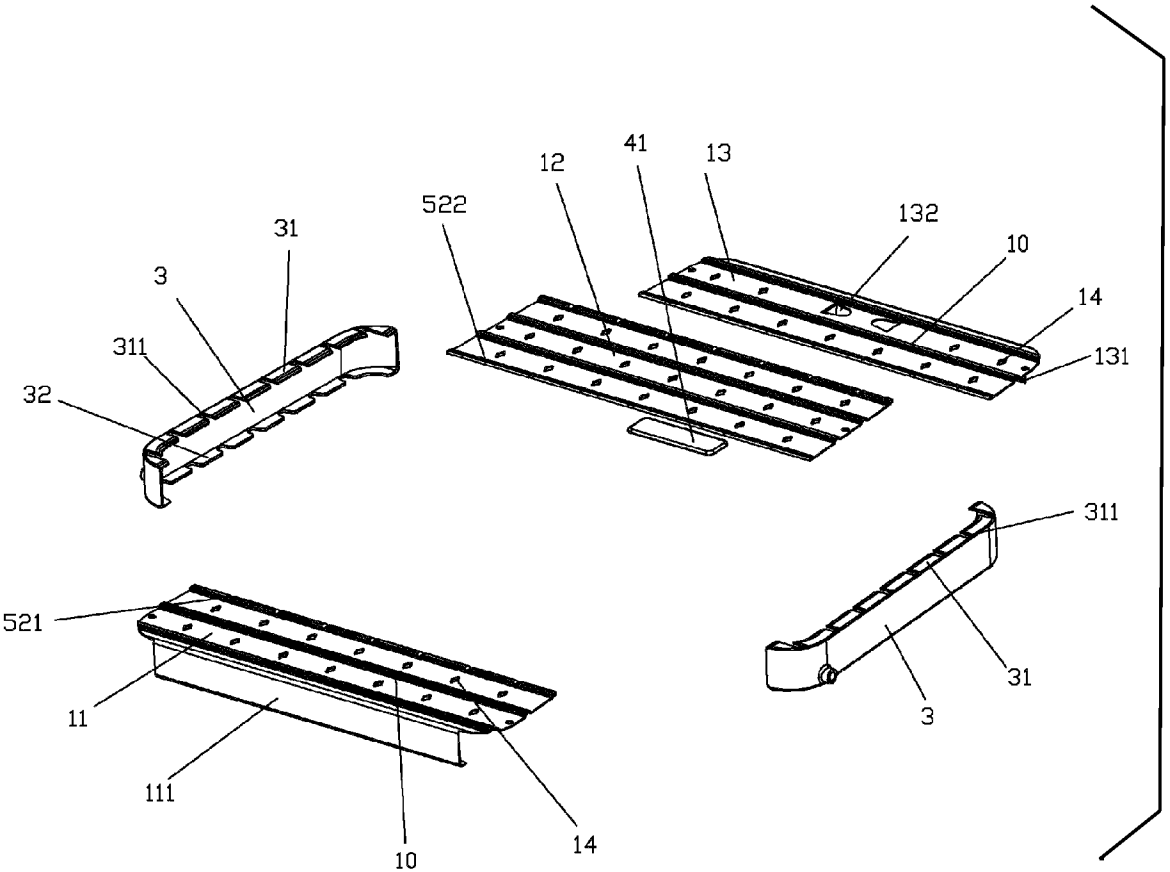
FIG. 12 is an exploded view of embodiment 2.

Referring to FIG. 12, the top step for an aluminum step ladder in accordance with the present invention differs from embodiment 1 in that embodiment 2 has no metal tube, and the top step comprises an assembled aluminum member 1 and the side plastic members 3. Since there is no metal tube, no rivet is needed to attach the assembled aluminum member.

Embodiment 3

Figure 13:
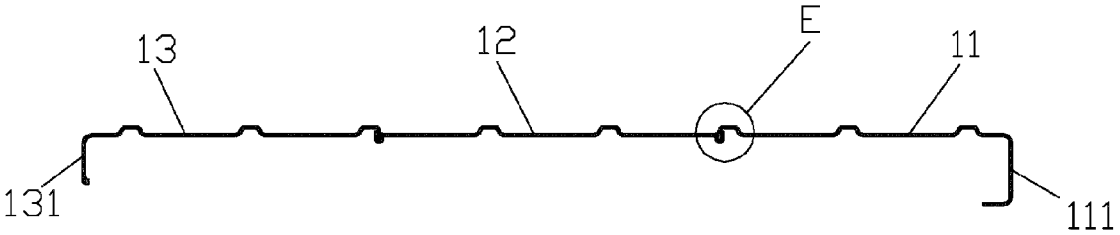
FIG. 13 illustrates a sectional view of the assembled aluminum member of embodiment 3.
Figure 14:
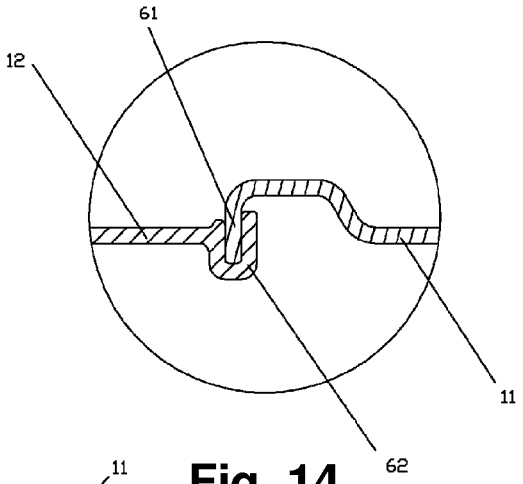
FIG. 14 illustrates an enlarged view of the E section in FIG. 13.

Referring to FIG. 13 and FIG. 14, the top step for an aluminum step ladder in accordance with the present invention differs from embodiment 1 in that embodiment 3 has the edge of the first step element of the two neighboring step elements (that is the front step element 11) provided with an L-shaped hook 61, and the edge of the second step element of the two neighboring step elements (that is the middle step element 12) provided with a U-shaped end 62 with an upwards is opening. The L-shaped hook 61 of the first step element inserts into the U-shape end 62 of the second step element, thereby holding the neighboring front step element 11 and the middle step element 12 together.

In this embodiment, the middle step element 12 and the rear step element 13 have the same structure to connect.

Embodiment 4

Figure 16:
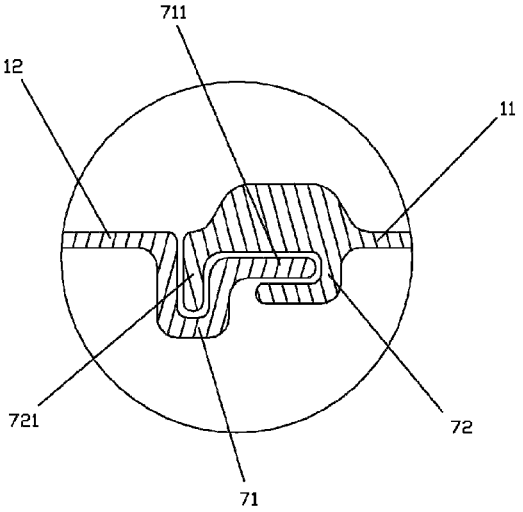
FIG. 16 illustrates an enlarged view of the F section in FIG. 15.
Figure 15:
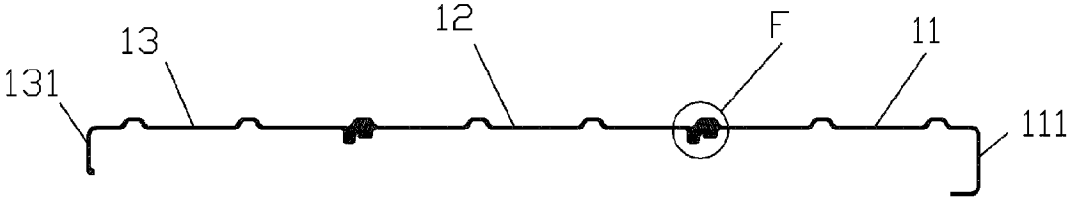
FIG. 15 illustrates a sectional view of the assembled aluminum member of embodiment 4.

Referring to FIG. 15 and FIG. 16, the top step for an aluminum step ladder in accordance with the present invention differs from embodiment 1 in that embodiment 4 has the edge of the first step element of the two neighboring step elements (that is the middle step element 12) provided with a U-shaped end 71 opening upwards and a horizontal hook extending outwards, and the edge of the second step element of the two neighboring step elements (that is the front step element 11) provided with a sideways U-shaped end 72 opening inwards and a vertical hook 721 extending downwards. The horizontal hook 711 of the first step element engages the sideways U-shaped end 72 of the second step element, and the vertical hook 721 of the second step element engages with the U-shaped end 71 of the first step element, thereby holding the neighboring front step element 11 and the middle step element 12 together.

In this embodiment, the middle step element 12 and the rear step element 13 have the same structure to connect.

Embodiment 5

Figure 17:
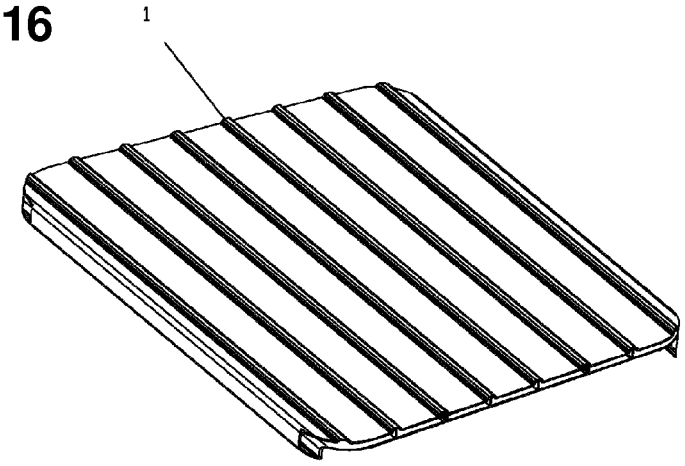
FIG. 17 is a perspective structure of the assembled aluminum member of embodiment 5.
Figure 18:
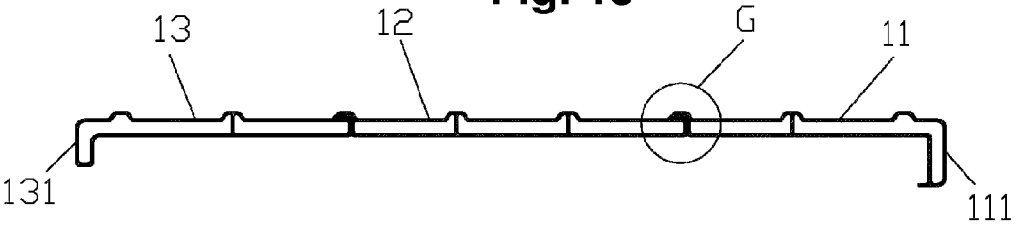
FIG. 18 illustrates a sectional view of the assembled aluminum member of embodiment 5.
Figure 19:
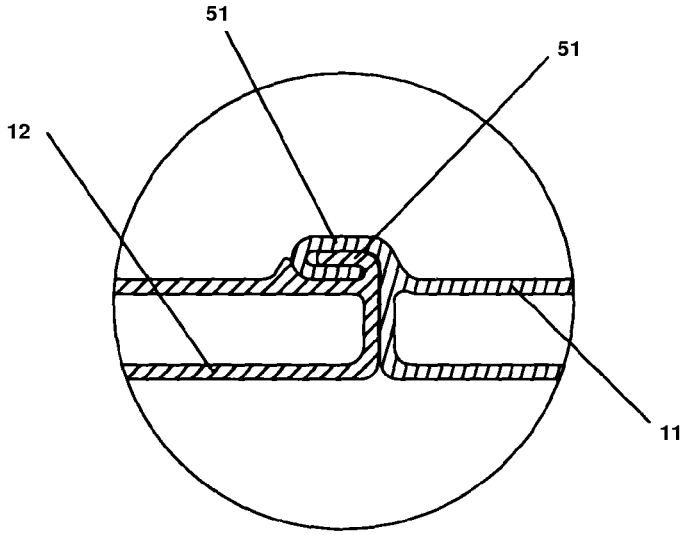
FIG. 19 illustrates an enlarged view of the G section of FIG. 18.

Referring to FIGS. 17-19, the top step for an aluminum step ladder in accordance with the present invention differs from embodiment 1 in that embodiment 5 has the step element with a double-layer structure including one or more cavities. At the same time, since the double-layer structure is stronger than a single-layer structure, the top step does not necessitate a metal tube. In case a metal tube is needed to enhance the strength of the top step, two individual tubes may be inserted into the cavity on the two sides of the assembled aluminum member 1. Alternatively, a metal tube in an H-shape, a U-shape or a closed-framed shape may be placed at the bottom of the assembled aluminum member 1.

Embodiment 6

Figure 20:
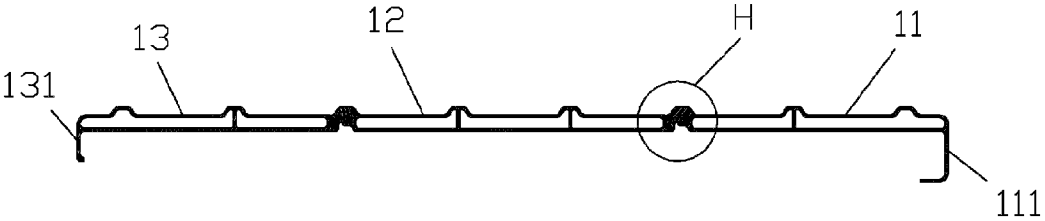
FIG. 20 illustrates a sectional view of the assembled aluminum member of embodiment 6.
Figure 21:
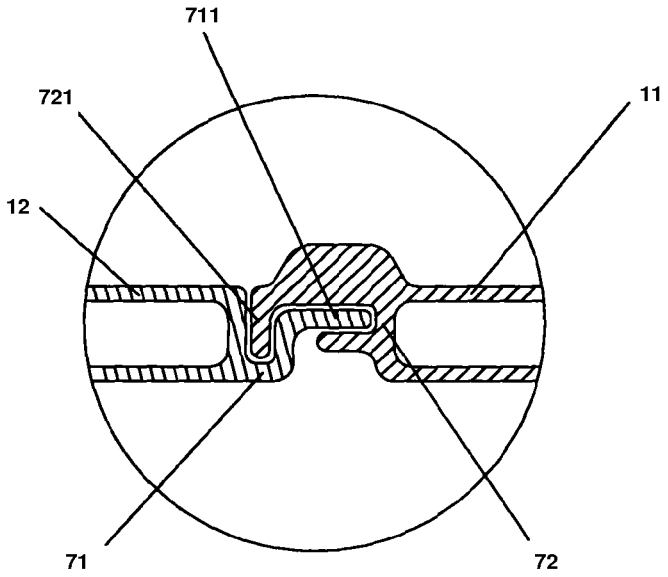
FIG. 21 illustrates an enlarged view of the H section in FIG. 20.

Referring to FIG. 20 and FIG. 21, the top step for an aluminum step ladder in accordance with the present invention differs from embodiment 1 in that embodiment 6 has a step element with a double-layer structure including one or more cavities. At the same time, since the double-layer structure is stronger than a single-layer structure, the top step does not necessitate a metal tube. In case a metal tube is needed to enhance the strength of the top step, two individual tubes may be inserted into the cavity on the two sides of the assembled aluminum member 1. Alternatively, a metal tube in an H-shape, a U-shape or a closed-framed shape, may be placed at the bottom of the assembled aluminum member 1. The edge of the first step element of the two assembled neighboring step elements (that is the middle step element 12) is provided with a U-shaped end 71 opening upwards and a horizontal hook extending outwards, and the edge of the second step element of the two assembled neighboring step elements (that is the front step element 11) is provided with a sideways U-shaped end 72 opening inwards and a vertical hook 721 extending downwards. The horizontal hook 711 of the first step element (that is the middle step element 12) engages the sideways U-shaped end 72 of the second step element, and the vertical hook 721 of the second step element engages the U-shaped end 71 of the first step element holding the neighboring front step element 11 and the middle step element 12 together.

In this embodiment, the middle step element 12 and the rear step element 13 have the same structure to connect.

Although the present invention has been fully described by ways of preferred embodiments with reference to the accompanying drawings, it is to be noted that various changes and modifications will be apparent to those skilled in the art. Therefore, unless otherwise such changes and modifications depart from the scopes of the present invention, they should be construed as being included therein.

INDUSTRIAL APPLICABILITY

The present invention relates to a top step for an aluminum step ladder, made from aluminum parts and plastic parts. The top step of the aluminum ladder is easy to manufacture, has an appealing appearance, a solid support, a low production cost, and a good industrial applicability.

What is claimed is:

1. A step ladder comprising:

two rear leg tubes;

two front leg tubes pivotally joining the two rear leg tubes at respective ends of the rear leg tubes;

at least one bottom step located between the two front leg tubes; and a top step having a front portion and a rear portion, the front portion being pivotally connected to the two front leg tubes, the rear portion joining the two rear leg tubes through two connecting members, the top step comprising:

an assembled member having a front step element, a middle step element and a rear step element, the front step element extending downwards at a front end to form a front skirt and having a rear edge with a rear end, the middle step element having a rear edge with a middle-rear end, and a front edge with a middle-front end, and the rear step element extending downwards at a rear end to form a rear skirt and having a front edge with a front end; and a metal tube located at two sides of the assembled member between the front skirt and the rear skirt;

wherein each of the rear step element front end, the middle-rear end, the middle-front end, and the front step element rear end forms a U-shaped hook in a sectional view, wherein the U-shaped hook at the rear step element has a rear short end, the U-shaped hook at the middle-rear end has a middle-rear short end, the U-shaped hook at the middle-front end has a middle-front short end, and the U-shaped hook at the front-step element has a front short end, wherein the rear short end extends from and in parallel to the middle-rear short end, and the middle-front short end extends from and in parallel to the front short end, and wherein the rear short end is hooked and fastened to the U-shaped hook of the middle-rear end, the front short end is hooked and fastened to the U-shaped hook of the middle-front end.

2. The step ladder according to claim 1, wherein the two front leg tubes and the two rear leg tubes are made of aluminum.

3. The step ladder according to claim 1, wherein the front step element, the middle step element, and the rear step element are made of aluminum.

4. The step ladder according to claim 1, wherein the front step element, the middle step element, and the rear step element are single-layered structures.

5. The step ladder according to claim 1, wherein the metal tube is made of iron.

6. The step ladder according to claim 1, wherein the metal tube is made of aluminum.

7. The step ladder according to claim 1, wherein the metal tube has a U shape.

8. The step ladder according to claim 1, wherein a surface of the front step element, a surface of the middle step element, and a surface of the rear step element have raised lines.

9. The step ladder according to claim 1, wherein a surface of the front step element, a surface of the middle step element, and a surface of the rear step element have impressions arranged in rows.

10. The step ladder according to claim 1, wherein the front step element, the middle step element, and the rear step element are riveted to the metal tube.

11. The step ladder according to claim 1, further comprising two side members covering the metal tube at the two sides of the assembled member and a space between the front skirt and the rear skirt, each of the side members having an upper covering edge and a lower covering edge; the upper covering edge and the lower covering edge of each of the side members clamp to a respective side of the assembled member.

12. The step ladder according to claim 11, wherein the two side members are made of plastic.

* * * * *